US007787815B2

(12) United States Patent
Nakamura et al.

(10) Patent No.: US 7,787,815 B2
(45) Date of Patent: Aug. 31, 2010

(54) IMAGE FORMING DEVICE

(75) Inventors: Reki Nakamura, Kanagawa (JP); Kei Yasutomi, Kanagawa (JP); Hitoshi Maruyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 310 days.

(21) Appl. No.: 11/835,052

(22) Filed: Aug. 7, 2007

(65) Prior Publication Data

US 2008/0056784 A1 Mar. 6, 2008

(30) Foreign Application Priority Data

Sep. 4, 2006 (JP) ..... 2006-239569

(51) Int. Cl.
*G03G 15/20* (2006.01)
*G03G 13/20* (2006.01)
*G03G 13/16* (2006.01)

(52) U.S. Cl. ..... 399/341; 399/68; 399/320; 399/322; 399/342; 430/124.13; 430/126.1

(58) Field of Classification Search ..... 399/320, 399/337, 341, 342, 358, 411; 430/124.13, 430/124.2, 126.1
See application file for complete search history.

(56) References Cited

U.S. PATENT DOCUMENTS 5,155,536 A * 10/1992 Johnson et al. ..... 399/329
5,428,430 A * 6/1995 Aslam et al. ..... 399/307
5,795,696 A * 8/1998 Malhotra ..... 430/126.1
5,842,097 A * 11/1998 Kanbayashi et al. ... 430/125.31
6,916,583 B1 * 7/2005 Landa et al. ..... 430/11
7,551,868 B2 * 6/2009 Yasutomi et al. ..... 399/67
2004/0042809 A1 * 3/2004 Fuma et al. ..... 399/67
2006/0275677 A1 * 12/2006 Okamoto ..... 430/18
2007/0086803 A1 * 4/2007 Kimura et al. ..... 399/69

(Continued)

FOREIGN PATENT DOCUMENTS

JP 61-122666 6/1986

(Continued)

OTHER PUBLICATIONS

U.S. Appl. No. 12/144,267, filed Jun. 23, 2008, Yasutomi et al.

*Primary Examiner*—David M Gray
*Assistant Examiner*—Francis Gray
(74) *Attorney, Agent, or Firm*—Oblon, Spivak, McClelland, Maier & Neustadt, L.L.P.

(57) ABSTRACT

An image forming device is disclosed that is able to superpose a smooth sheet on a toner image on a recording sheet after common thermal fusing, perform re-melting and solidification, and then separate the smooth sheet, thereby, forming a high-gloss image easily. The image forming device includes a first fusing unit for the common thermal fusing, and a second fusing unit for fusing the toner image on a recording sheet after the common thermal fusing with a gloss application sheet superposed on the toner image, and a separation unit for separating the gloss application sheet from the recording sheet. The gloss application sheet is superposed on the recording sheet with a side of the gloss application sheet projecting out beyond a side of the recording sheet on a downstream side in the conveyance direction, and the gloss application sheet and the recording sheet are directed into the separation unit while being superposed.

4 Claims, 5 Drawing Sheets

U.S. PATENT DOCUMENTS

| | | | |
|---|---|---|---|
| 2007/0164505 | A1 | 7/2007 | Ishibashi et al. |

FOREIGN PATENT DOCUMENTS

| | | |
|---|---|---|
| JP | 63-92965 | 4/1988 |
| JP | 4-31389 | 5/1992 |
| JP | 4-369677 | 12/1992 |
| JP | 5-249724 | 9/1993 |
| JP | 9-150456 | 6/1997 |
| JP | 3213969 | 7/2001 |
| JP | 2001-222171 | 8/2001 |
| JP | 2002-91048 | 3/2002 |
| JP | 2002-372882 | 12/2002 |
| JP | 2003-76096 | 3/2003 |
| JP | 2003-76201 | 3/2003 |

* cited by examiner

IMAGE FORMING DEVICE

BACKGROUND OF THE INVENTION

1. Field of the Invention

The present invention relates to an electrophotographic image forming device including a first fusing unit and a second fusing unit for fusing a toner image on a recording sheet with a gloss application sheet superposed on the toner image.

2. Description of the Related Art

In an image forming device of the related art, after a toner image is fused on a recording sheet (a transfer sheet) by common thermal fusing, the recording sheet and a gloss application sheet are further subjected to a second fusing for applying gloss on the recording sheet. For example, this technique is disclosed in Japanese Laid-Open Patent Application No. 5-249724 (hereinafter referred to as "reference 1"), Japanese Laid-Open Patent Application No. 61-122666 (hereinafter referred to as "reference 2"), Japanese Laid-Open Patent Application No. 2001-222171 (hereinafter referred to as "reference 3"), Japanese Laid-Open Patent Application No. 4-31393 (hereinafter referred to as "reference 4"), and Japanese Laid-Open Patent Application No. 2003-76201 (hereinafter referred to as "reference 5").

In reference 1 and reference 2, it is disclosed that the gloss application sheet is superposed on the recording sheet while the recording sheet is projected with respect to the gloss application sheet.

Reference 3 discloses a technique for changing the gloss of the image.

In reference 4, it is disclosed that a sheet is placed on a toner image on an image carrier, and heat and pressure are applied to re-melt the toner image; after the re-melted toner image cools, the sheet is removed from the image carrier, thereby improving image quality.

Reference 5 discloses a technique enabling formation of laminated layers on the upper and lower sides of an image recording member.

The gloss application sheet is in contact with the toner image on the recording sheet to make the toner image smooth and apply high gloss on the toner image. In order that the toner image on the recording sheet be fused during the second fusing with the gloss application sheet superposed on the toner image, it is necessary for the toner image to take out the smoothness of the recording sheet.

In this case, since the gloss application sheet is used only for smoothing the surface of the toner image on the recording sheet, it is required to remove the gloss application sheet from the toner image and the recording sheet.

However, since the toner image is melted and solidified by the second fusing while the toner image is in contact with the gloss application sheet, the gloss application sheet is also in contact with the recording sheet, and it is not easy to separate the gloss application sheet from the recording sheet.

Especially, when the gloss application sheet overlaps the recording sheet perfectly without deviation, it is difficult to manipulate the gloss application sheet and the recording sheet independently, and it is more difficult to separate the gloss application sheet from the recording sheet.

SUMMARY OF THE INVENTION

The present invention may solve one or more problems of the related art.

A preferred embodiment of the present invention may provide an electrophotographic image forming device able to superpose a smooth sheet on a toner image on a recording sheet after common thermal fusing, perform re-melting and solidification, and then separate the smooth sheet, thereby, forming a high-gloss image easily.

According to a first aspect of the present invention, there is provided an image forming device, comprising:

a first fusing unit that fuses a toner image on a recording sheet;

a second fusing unit that fuses the toner image fused by the first fusing unit with a gloss application sheet superposed on the toner image on the recording sheet; and a separation unit that separates the gloss application sheet from the recording sheet, wherein the gloss application sheet is superposed on the recording sheet with a side of the gloss application sheet projecting out of a side of the recording sheet on a downstream side in a conveyance direction, and the gloss application sheet and the recording sheet are directed into the separation unit while being superposed.

As an embodiment, an end portion of the recording sheet in the conveyance direction includes a toner image forbidden area where formation of a toner image is not allowed. Preferably, a length of the toner image forbidden area is greater than a distance between a position where the gloss application sheet is separated from the recording sheet and a position of a conveyance roller for conveying the recording sheet.

As an embodiment, the separation unit includes a separating part at an end thereof for separating the gloss application sheet and the recording sheet, and the separation part is inserted into a space between the gloss application sheet and the recording sheet.

As an embodiment, the image forming device further comprises:

a conveyance unit that conveys the recording sheet superposed with the gloss application sheet at least nearby the separation unit, wherein the conveyance unit conveys the gloss application sheet by electrostatically attracting the gloss application sheet, and in a direction of enlarging the space between the recording sheet and the gloss application sheet.

As an embodiment, the image forming device further comprises:

a conveyance unit that conveys the recording sheet superposed with the gloss application sheet at least nearby the separation unit, wherein the conveyance unit is a conveyance belt, and conveys the gloss application sheet by attracting the gloss application sheet by an attracting effect of airflow, and in a direction of enlarging the space between the recording sheet and the gloss application sheet before the separation unit.

According to the present invention, since the gloss application sheet is superposed on the recording sheet with an offset, it is easy for a separating part to touch and separate the gloss application sheet.

These and other objects, features, and advantages of the present invention will become more apparent from the following detailed description of preferred embodiments given with reference to the accompanying drawings.

DESCRIPTION OF THE PREFERRED EMBODIMENTS

Below, preferred embodiments of the present invention are explained with reference to the accompanying drawings.

Figure 1:
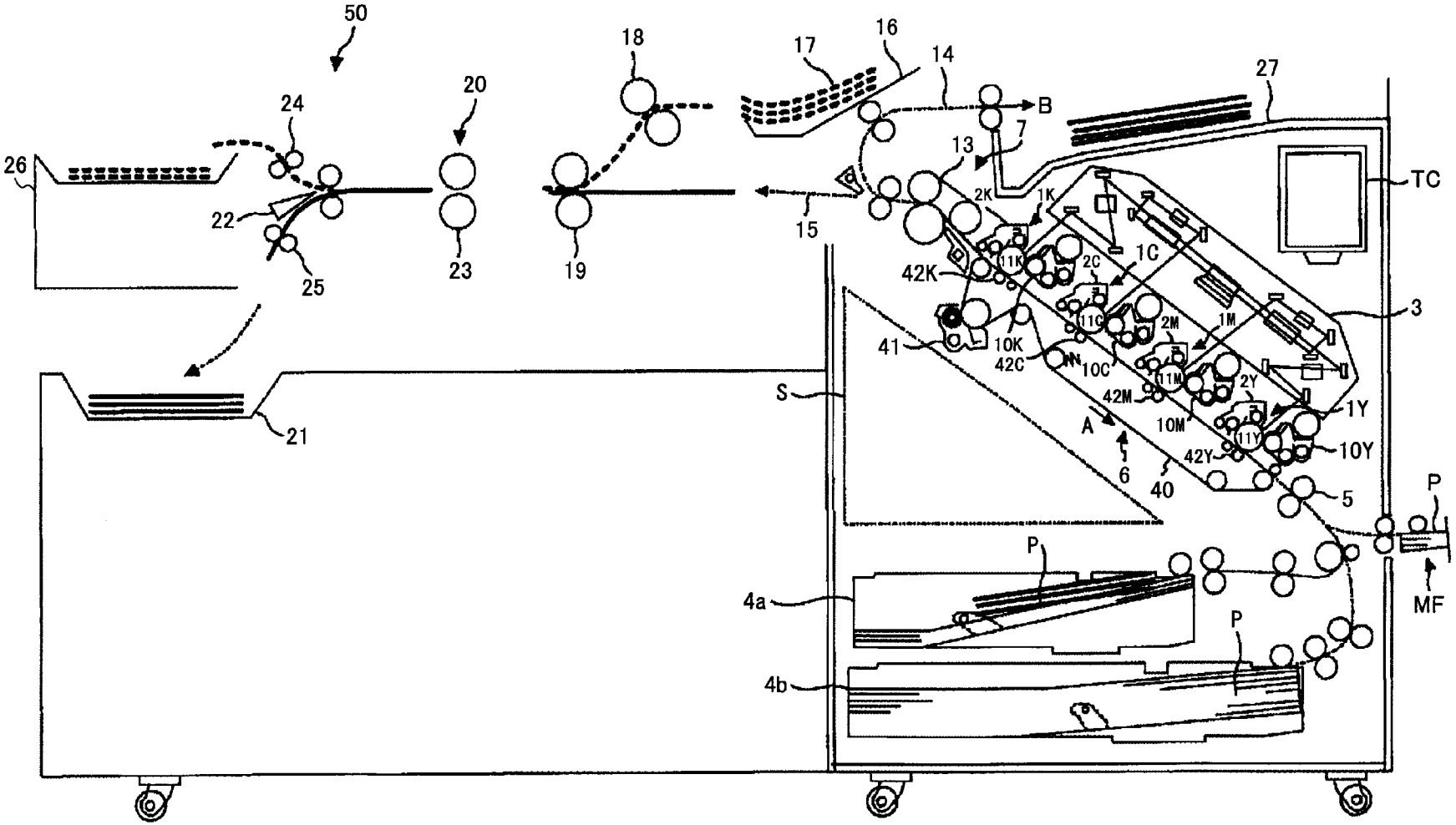
FIG. 1 is a schematic view illustrating a configuration of an electrophotographic image forming device according to an embodiment of the present invention.

FIG. 1 is a schematic view illustrating a configuration of an electrophotographic image forming device according to an embodiment of the present invention.

As shown in FIG. 1, an image forming device 50 includes four image forming units 1Y, 1M, 1C, 1K for forming yellow (Y), magenta (M), cyan (C), and black (K) simple color images, respectively. It should be noted that in the present embodiment, the order of the image forming units 1Y, 1M, 1C, 1K is not limited to that shown in FIG. 1.

The image forming units 1Y, 1M, 1C, 1K includes photoconductive drums 11Y, 11M, 11C, 11K, respectively, which serve as image carriers, charging units, developing units 10Y, 10M, 10C, 10K, respectively, and cleaners.

The image forming units 1Y, 1M, 1C, 1K are arranged so that the rotational axes of the photoconductive drums 11Y, 11M, 11C, 11K are parallel to each other and are at specified intervals in the movement direction of transfer sheets.

The image forming device 50 has a light writing unit 3 above the image forming units 1Y, 1M, 1C, 1K, which includes light sources, polygonal mirrors, f-θ lenses, and reflecting mirrors. The light writing unit 3, based on input image data, irradiates laser beams and moves the laser beams to scan the corresponding surfaces of the image forming units 1Y, 1M, 1C, 1K.

The image forming device 50 further includes a transfer unit 6 (serving as a belt driving device) below the image forming units 1Y, 1M, 1C, 1K, which has a transfer belt 40 for carrying transfer sheets (recording sheets) and conveying the transfer sheets to pass through transferring parts of the image forming units 1Y, 1M, 1C, 1K.

A cleaning device 41, which includes brush rollers and cleaning blades, is arranged to be in contact with the outside surface of the transfer belt 40. The cleaning device 41 removes foreign matter like toner adhering to the transfer belt 40.

A fusing unit 7 (for example, a fusing belt) and a paper delivery tray are arranged on one side of the transferring unit 6. Below the image forming device 50, there are paper feeding cassettes 4*a*, 4*b* for accommodating transfer sheets P. In addition, there is a manual feeding tray MF for manually feeding paper from the side of the image forming device 50.

Further, there is a toner supplementing device TC; in addition, non-illustrated used toner bottles, double-sided units, power units, and others are arranged in the space S indicated by dot-dashed lines.

The developing units 10Y, 10M, 10C, 10K have the same structure, but use toner of different colors; the developing units 10Y, 10M, 10C, 10K perform developing by two-component developing. The developing units 10Y, 10M, 10C, 10K hold a developing agent made of toner and a magnetic carrier.

The developing units 10Y, 10M, 10C, 10K include developing rollers facing the photoconductive drums 11Y, 11M, 11C, 11K, respectively, screws for conveying and stirring the developing agent, and toner density sensors. The developing rollers include rotatable sleeves on the outer side and magnets fixed on the inner side. The toner supplementing device supplements toner in accordance with output signals from the toner density sensors.

Below, operations of forming images by the image forming device 50 are described.

First, a specified voltage is applied on the charging rollers from not-illustrated power supplies to charge the surfaces of the photoconductive drums 11Y, 11M, 11C, 11K. Subsequently, based on input image data, the light writing unit 3 irradiates laser beams to scan the surfaces of the corresponding photoconductive drums 11Y, 11M, 11C, 11K, thereby forming latent images on the surfaces of the photoconductive drums 11Y, 11M, 11C, 11K.

When the surfaces of the photoconductive drums 11Y, 11M, 11C, 11K, which carry the latent images, arrive at the developing units 10Y, 10M, 10C, 10K, the developing rollers respectively facing the photoconductive drums 11Y, 11M, 11C, 11K supply toner on the latent images on the surfaces of the photoconductive drums 11Y, 11M, 11C, 11K to form toner images.

The above operations are repeated for each of the photoconductive units 2Y, 2M, 2C, 2K at specified timings, and hence, toner images of corresponding different colors are formed on the surfaces of the photoconductive drums 11Y, 11M, 11C, 11K, respectively.

A transfer sheet P is conveyed by either the paper feeding cassettes 4*a*, 4*b* or the manual feeding tray MF and stops for a while when arriving at a resist roller 5. In accordance with the timings of image formation of the photoconductive units 2Y, 2M, 2C, 2K, the transfer sheet P is sent out from the resist roller 5, and the toner images on the photoconductive drums 11Y, 11M, 11C, 11K are transferred sequentially onto the transfer sheet P while the transfer sheet P is being conveyed by the transfer belt 40.

The transfer of the toner images from the photoconductive drums 11Y, 11M, 11C, 11K onto the transfer sheet P is performed by applying voltages of a polarity negative to the polarity of the toner on the photoconductive drums 11Y, 11M, 11C, 11K from primary transfer rollers 42Y, 42M, 42C, 42K, which are arranged to face the photoconductive drums 11Y, 11M, 11C, 11K, respectively, with the transfer belt 40 in between.

The transfer sheet P passes through a position opposite to the photoconductive drum 11K, with the toner images of four colors superposed on the transfer sheet P. Then, the transfer sheet P is conveyed to the fusing unit 7, and heat and pressure are applied to fuse the image.

It should be noted that the image forming device of the present embodiment is not limited to the above configuration. For example, instead of lasers, LEDs can be used to write images on the photoconductive drums 11Y, 11M, 11C, 11K; in addition, instead of two-component developing, the developing units 10Y, 10M, 10C, 10K can perform developing by one-component developing; further, instead of a fusing belt, the fusing unit 7 may be a roller, or employ induction heating.

After the image is fused by the fusing unit 7, when a usual image is output without using a gloss application sheet, after the transfer sheet P passes through a first fusing unit 13, the transfer sheet P is delivered in a first delivery direction 14 to a usual image output tray 27.

Below, operations of outputting a high-gloss image by using a gloss application sheet are described with reference to FIG. 1. Below, it is assumed that the transfer sheet P is conveyed by a conveyance roller.

First, the transfer sheet P with images thereon passes through the first fusing unit 13, but the transfer sheet P is not delivered in the first delivery direction 14, but conveyed in a second delivery direction 15. At this moment, a gloss application sheet 17 is conveyed, at the timing of conveying the transfer sheet P, by a first conveyance roller 18 from a gloss application sheet tray 16. A second conveyance roller 19 presses the transfer sheet P and the gloss application sheet 17 in close contact to overlap each other.

Figure 2:
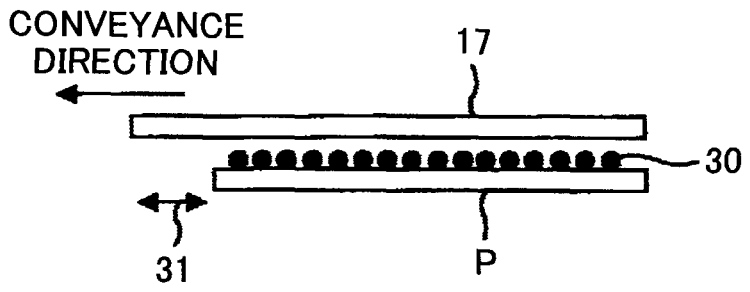
FIG. 2 is a schematic view illustrating superposition of the transfer sheet P and the gloss application sheet 17.

FIG. 2 is a schematic view illustrating superposition of the transfer sheet P and the gloss application sheet 17.

As shown in FIG. 2, when superposing the gloss application sheet 17 and the transfer sheet P carrying toner images, one side of the gloss application sheet 17 projects out beyond the side of the transfer sheet P in the conveyance direction; in other words, the gloss application sheet 17 has a position offset in the conveyance direction.

Under this condition, the gloss application sheet 17 and the transfer sheet P enter into a second fusing unit 20, and a heated fusing roller melts the toner image 30 on the transfer sheet P.

Figure 3:
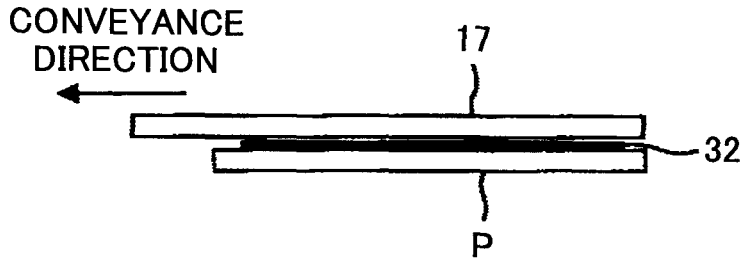
FIG. 3 is a schematic view illustrating superposition of the transfer sheet P and the gloss application sheet 17 after passing through the second fusing unit 20.

FIG. 3 is a schematic view illustrating superposition of the transfer sheet P and the gloss application sheet 17 after passing through the second fusing unit 20.

As shown in FIG. 3, when the toner on the transfer sheet P is melted, the toner is in contact with the flat surface of the gloss application sheet 17, and is then solidified; thereby, a toner image 32 having a smooth surface is obtained.

Therefore, it is possible to form a toner image having a high-gloss surface. Then, the gloss application sheet 17 and the transfer sheet P carrying the final image for output pass through a third conveyance roller 23, and the gloss application sheet 17 is removed. Then only the transfer sheet P carrying the image having the high-gloss surface is delivered to a transfer sheet delivery tray 21.

The gloss application sheet 17 and the transfer sheet P are separated from each other by a separating member 22, the gloss application sheet 17 is conveyed by a fourth conveyance roller 24, and the transfer sheet P is conveyed by a fifth conveyance roller 25.

In this process, the toner between the gloss application sheet 17 and the transfer sheet P is in close contact with the gloss application sheet 17 and the transfer sheet P, so that the gloss application sheet 17 and the transfer sheet P cannot be easily separated from each other at the portion where the toner is in close contact with the gloss application sheet 17 and the transfer sheet P. Thus the gloss application sheet 17 and the transfer sheet P are stuck together.

To solve this problem, as shown in FIG. 2 and FIG. 3, since one side of the gloss application sheet 17 projects out beyond the side of the transfer sheet 7 in the conveyance direction, it is possible to divert the gloss application sheet 17 first; hence the gloss application sheet 17 and the transfer sheet P cannot be easily separated from each other by the separating member 22.

Figure 4:
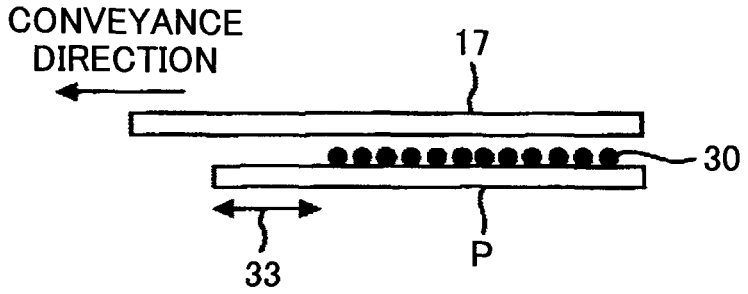
FIG. 4 is a schematic view illustrating superposition of the gloss application sheet 17 and the transfer sheet P having a toner image forbidden area.

FIG. 4 is a schematic view illustrating superposition of the gloss application sheet 17 and the transfer sheet P having a toner image forbidden area.

In order to more easily separate the gloss application sheet 17 and the transfer sheet P from each other, a toner image forbidden area may be formed near an end of the transfer sheet P in the conveyance direction, where formation of a toner image is not allowed.

As shown in FIG. 4, a toner image forbidden area 33 is formed near the end of the transfer sheet P in the conveyance direction, namely, the toner image is not formed in the toner image forbidden area 33. Due to the presence of the toner image forbidden area 33, the gloss application sheet 17 and the transfer sheet P are not stuck together in the toner image forbidden area 33, namely, the gloss application sheet 17 and the transfer sheet P are not stuck together near the end of the transfer sheet P.

If the toner image forbidden area 33 does not exist, the gloss application sheet 17 and the transfer sheet P are stuck together even near the end of the transfer sheet P; due to this, it is difficult to insert the separating member 22 (refer to FIG. 1) into the space between the gloss application sheet 17 and the transfer sheet P to separate the gloss application sheet 17 and the transfer sheet P from each other.

Therefore, due to the presence of the toner image forbidden area 33 on the transfer sheet P, it is easy to insert the separating member 22 into the space between the gloss application sheet 17 and the transfer sheet P, and after the second fusing process, it is easy to separate the gloss application sheet 17 and the transfer sheet P from each other.

The toner on the transfer sheet P sticks to the gloss application sheet 17 and the transfer sheet P. When the gloss application sheet 17 and the transfer sheet P are separated by using the separating member 22, both of the gloss application sheet 17 and the transfer sheet P, or one of the gloss application sheet 17 and the transfer sheet P having a large unsticking area, have a high degree of freedom for separation, and this makes it easy to separate the gloss application sheet 17 and the transfer sheet P.

Figure 5:
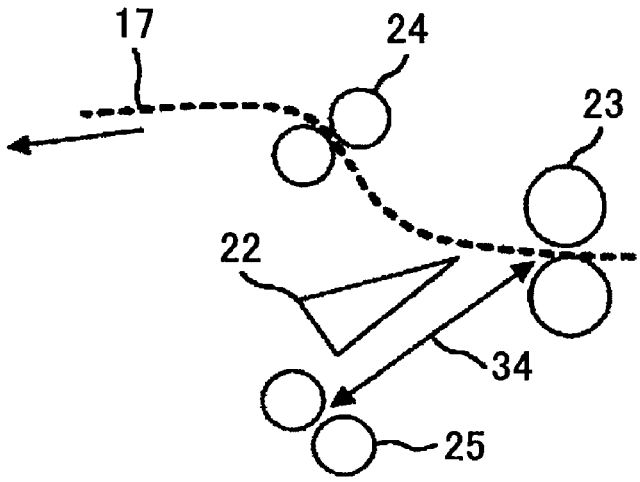
FIG. 5 is a schematic view illustrating the relationship between the length of the toner image forbidden area 33 and the distance between the position of separating the gloss application sheet 17 and the transfer sheet P and the conveyance roller 25 for conveying the transfer sheet P.

FIG. 5 is a schematic view illustrating the relationship between the length of the toner image forbidden area 33 and the distance between the position of separating the gloss application sheet 17 and the transfer sheet P and the conveyance roller 25 for conveying the transfer sheet P.

Figure 6:
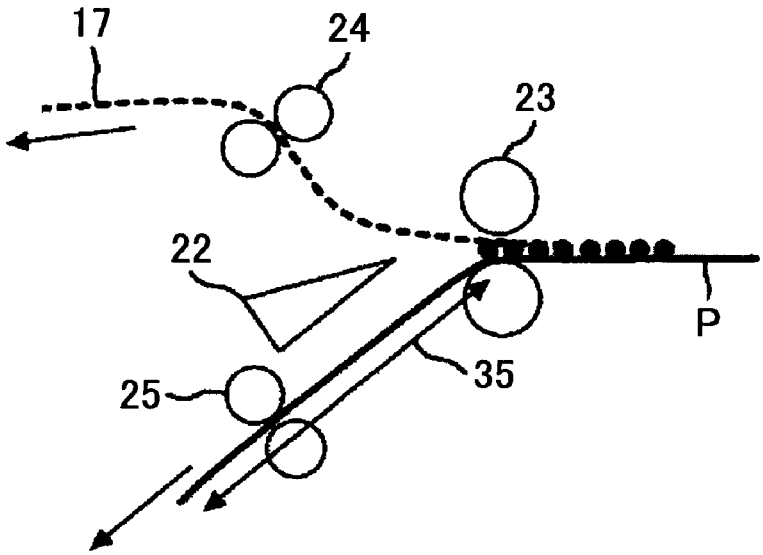
FIG. 6 is a schematic view illustrating the relationship in the conveyance direction between the length of the toner image forbidden area 33 and the distance between the position of separating the gloss application sheet 17 and the transfer sheet P and the conveyance roller 25 for conveying the transfer sheet P.

FIG. 6 is a schematic view illustrating the relationship in the conveyance direction between the length of the toner image forbidden area 33 and the distance between the position of separating the gloss application sheet 17 and the transfer sheet P and the conveyance roller 25 for conveying the transfer sheet P.

As shown in FIG. 5 and FIG. 6, first, the distance between the position of separating the gloss application sheet 17 and the transfer sheet P, that is, the position of the third conveyance roller 23, and the fifth conveyance roller 25 for conveying the transfer sheet P is denoted as d1 (indicated by a reference number 34).

Additionally, near the end of the transfer sheet P where the length of the toner image forbidden area 33 is formed, the length from the end of the transfer sheet P to the starting edge of the toner image is denoted as d2 (35). Namely, the length of the toner image forbidden area 33 is d2 (indicated by a reference number 35).

In the present embodiment, in the conveyance direction of the transfer sheet P, the toner image forbidden area 33 is defined so that the length of the toner image forbidden area 33 is greater than the distance between the position of separating the gloss application sheet 17 and the transfer sheet P (namely, the position of the third conveyance roller 23) and the fifth conveyance roller 25 for conveying the transfer sheet P. In other words, the relationship d1<d2 is satisfied.

With such a configuration, it is possible to more easily separate the gloss application sheet 17 and the transfer sheet P. Because the gloss application sheet 17 and the transfer sheet P are stuck together by the toner at positions where the toner exists, separation action is required to separate the gloss application sheet 17 and the transfer sheet P. On the other hand, at positions where the toner does not exist, since the gloss application sheet 17 and the transfer sheet P are not stuck, that is, there is no sticking action, and the gloss application sheet 17 and the transfer sheet P have been already separated, separation action is not required; thus it is quite easy to separate the gloss application sheet 17 and the transfer sheet P at positions where the toner does not exist.

In order to separate the portion where the gloss application sheet 17 and the transfer sheet P are stuck together by the toner, in the present embodiment, the gloss application sheet 17 and the transfer sheet P are conveyed by the fourth conveyance roller 24 and the fifth conveyance roller 25, respectively, in different directions compulsorily, and this separates the portions where the gloss application sheet 17 and the transfer sheet P are stuck together by the toner.

The fourth conveyance roller 24 conveys the gloss application sheet 17, and the fifth conveyance roller 25 conveys the transfer sheet P. In the present embodiment, since the relation d1<d2 holds, the gloss application sheet 17 and the transfer sheet P are not stuck together by the toner before the gloss application sheet 17 and the transfer sheet P are respectively caught by the fourth conveyance roller 24 and the fifth conveyance roller 25.

Next, when the toner sticking portion of the gloss application sheet 17 and the transfer sheet P arrives at the fifth conveyance roller 25, the gloss application sheet 17 and the transfer sheet P are caught by the fourth conveyance roller 24 and the fifth conveyance roller 25, respectively, and due to this, the toner sticking portion of the gloss application sheet 17 and the transfer sheet P is separated by the conveying force of the fourth conveyance roller 24 and the fifth conveyance roller 25, while the toner sticking portion of the gloss application sheet 17 and the transfer sheet P are conveyed forward.

In this way, in the conveyance direction of the transfer sheet P, since the length of the toner image forbidden area 33 is greater than the distance between the position of separating the gloss application sheet 17 and the transfer sheet P (namely, the position of the third conveyance roller 23) and the fourth conveyance roller 24 and the fifth conveyance roller 25 (that is, d1<d2), before the toner sticking portion of the gloss application sheet 17 and the transfer sheet P arrives at the separation position, the fourth conveyance roller 24 and the fifth conveyance roller 25 carry and convey the gloss application sheet 17 and the transfer sheet P, respectively.

Due to this, after the toner sticking portion of the gloss application sheet 17 and the transfer sheet P arrives at the separation position, because of the strong conveyance force from the fourth conveyance roller 24 and the fifth conveyance roller 25, the gloss application sheet 17 and the transfer sheet P can be continuously separated, thus, satisfactory separation can be obtained.

As shown in FIG. 5 and FIG. 6, the separating member 22 has a sharp end like a talon, and the sharp end of the separation member 22 is inserted into the space between the gloss application sheet 17 and the transfer sheet P to separate the gloss application sheet 17 and the transfer sheet P. Further, the sharp end of the separation member 22 facilitates transition from close contact of the gloss application sheet 17 and the transfer sheet P to separation of the gloss application sheet 17 and the transfer sheet P.

Figure 7:
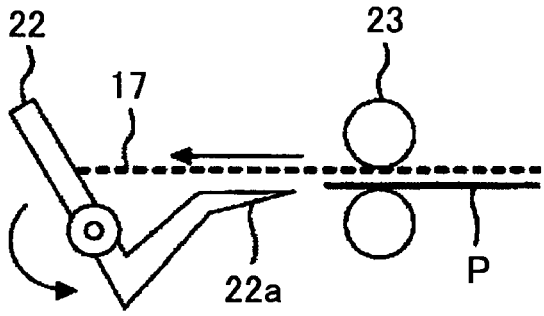
FIG. 7 is a schematic view illustrating another example of the separating member 22.

FIG. 7 is a schematic view illustrating another example of the separating member 22.

Figure 8:
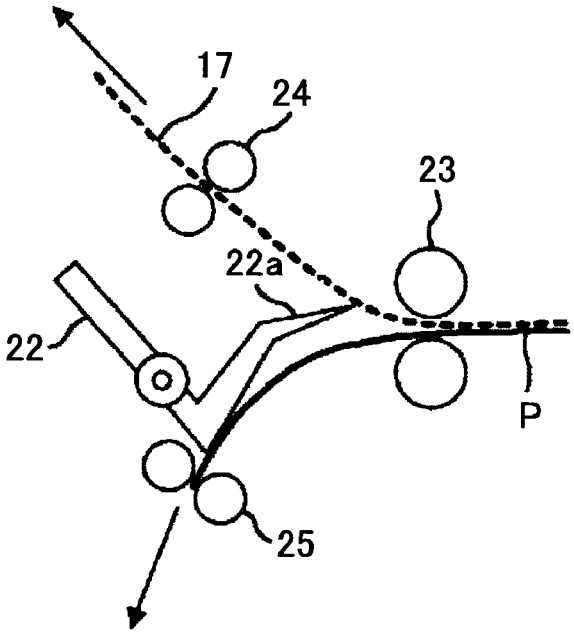
FIG. 8 is a schematic view illustrating the separating member 22 as shown in FIG. 7 which is in operation.

FIG. 8 is a schematic view illustrating the separating member 22 as shown in FIG. 7 which is in operation.

As shown in FIG. 7 and FIG. 8, the separating member 22 is rotatable, and has an L-shape with a sharp end 22*a* like a talon. The sharp end 22*a* is inserted into the space between the gloss application sheet 17 and the transfer sheet P to contact and apply a stress on the gloss application sheet 17; thus, the separating member 22 is rotated with respect to a supporting point of the separating member 22, and the sharp end 22*a* (talon portion) of the separating member 22 pushes up the gloss application sheet 17.

Therefore, as shown in FIG. 8, since the talon portion 22*a* enlarges the space between the gloss application sheet 17 and the transfer sheet P, and the talon portion 22*a* contacts the lower side of the gloss application sheet 17, it is easy for the talon portion 22*a* to enter the space between the gloss application sheet 17 and the transfer sheet P. Hence it is possible to easily and reliably separate the gloss application sheet 17 and the transfer sheet P.

The separated gloss application sheet 17 and the transfer sheet P are conveyed by the fourth conveyance roller 24 and the fifth conveyance roller 25, respectively. At the same time, a part of the talon portion 22*a* of the separating member 22 contacts the gloss application sheet 17, and this facilitates separation of the gloss application sheet 17.

Figure 9:
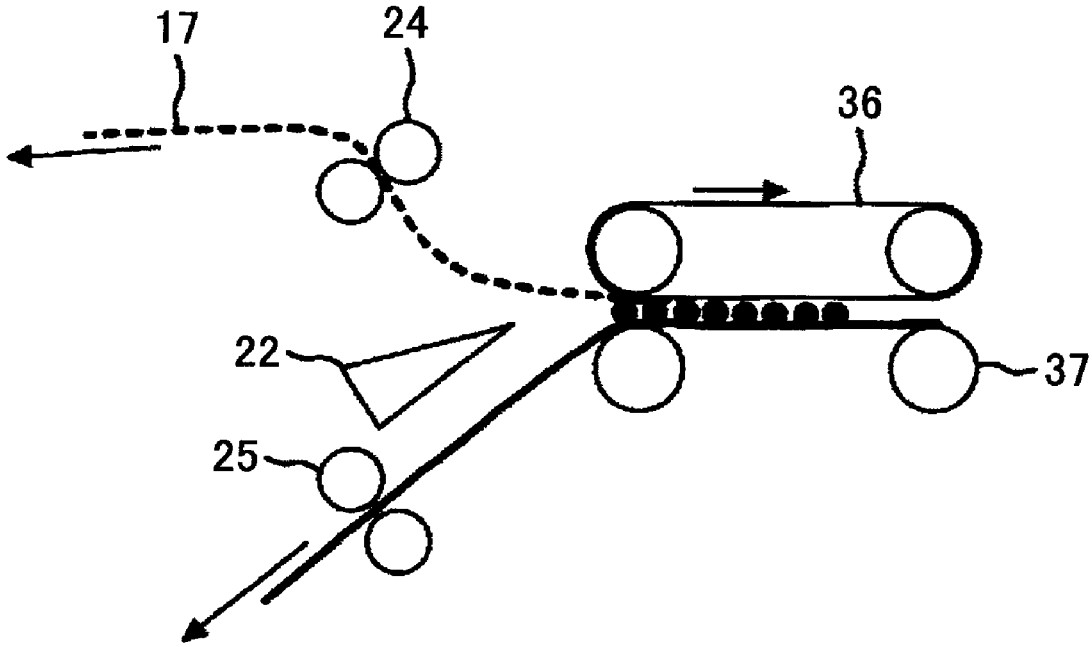
FIG. 9 is a schematic view illustrating another example of the image forming device 1 in which the third conveyance roller 23 is replaced by a conveyance belt 36.

FIG. 9 is a schematic view illustrating another example of the image forming device 1 in which the third conveyance roller 23 is replaced by a conveyance belt 36.

Figure 10:
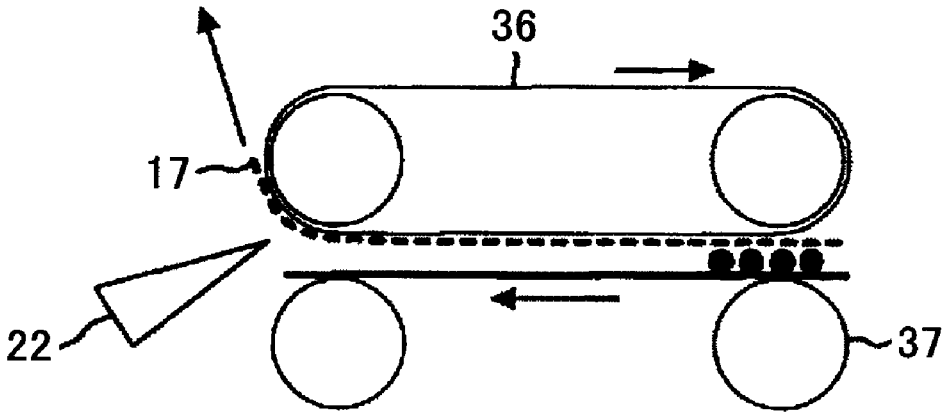
FIG. 10 is a schematic view illustrating the conveyance belt 36 and an electrostatic attraction roller 37 as shown in FIG. 9.

FIG. 10 is a schematic view illustrating the conveyance belt 36 and an electrostatic attraction roller 37 as shown in FIG. 9.

As shown in FIG. 9, the conveyance belt 36 is rotatable, and the conveyance belt 36 and the gloss application sheet 17 are charged by the electrostatic attraction roller 37.

Due to this, the gloss application sheet 17 is adhered to the electrostatic attraction roller 37, and is conveyed to the fourth conveyance roller 24. That is, the gloss application sheet 17 is conveyed while being adhered to the electrostatic attraction roller 37.

Since both of the gloss application sheet 17 and the transfer sheet P, or either of the gloss application sheet 17 and the transfer sheet P, are electrostatically adhered and conveyed by the electrostatic attraction roller 37, as described above, the gloss application sheet 17 is directly conveyed to the fourth conveyance roller 24 as long as it is adhered to the electrostatic attraction roller 37.

As shown in FIG. 10, since the gloss application sheet 17 is taken around by the curved portion of the conveyance belt 36, the gloss application sheet 17 is automatically separated from the transfer sheet P, due to this, the separating member 22 can separate the gloss application sheet 17 and the transfer sheet P more easily and more reliably.

Although not illustrated in detail, the conveyance belt 36 shown in FIG. 9 can be configured to have an adhesion capability due to airflow, and due to the adhesion capability, the gloss application sheet 17 is adhered to the conveyance belt 36 while being conveyed to the fourth conveyance roller 24.

In this process, since the gloss application sheet 17 is adhered to the conveyance belt 36, the gloss application sheet 17 is automatically separated from the transfer sheet P; therefore, the separating member 22 can separate the gloss application sheet 17 and the transfer sheet P more easily and more reliably.

It should be noted that when the conveyance belt 36 has the adhesion capability due to airflow, the electrostatic attraction roller 37 can be omitted.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

This patent application is based on Japanese Priority Patent Application No. 2006-239569 filed on Sep. 4, 2006, the entire contents of which are hereby incorporated by reference.

What is claimed is:

1. An image forming device, comprising:

a first fusing unit that fuses a toner image on a recording sheet;

a second fusing unit that fuses the toner image fused by the first fusing unit with a gloss application sheet superposed on the toner image on the recording sheet; and a separation unit that separates the gloss application sheet from the recording sheet, wherein:

the gloss application sheet is superposed on the recording sheet with a side of the gloss application sheet projecting out beyond a side of the recording sheet on a downstream side in a conveyance direction, and the gloss application sheet and the recording sheet are directed into the separation unit while being superposed, an end portion of the recording sheet in the conveyance direction includes a toner image forbidden area where formation of a toner image is not allowed, and a length of the toner image forbidden area is greater than a distance between a position where the gloss application sheet is separated from the recording sheet and a position of a conveyance roller for conveying the recording sheet.

2. The image forming device as claimed in claim 1, wherein the separation unit includes a separating part at an end thereof for separating the gloss application sheet and the recording sheet, and the separation part is inserted into a space between the gloss application sheet and the recording sheet.

3. The image forming device as claimed in claim 1, further comprising:

a conveyance unit that conveys the recording sheet superposed with the gloss application sheet at least nearby the separation unit, wherein the conveyance unit conveys the gloss application sheet by electrostatically adhering the gloss application sheet, and in a direction of enlarging the space between the recording sheet and the gloss application sheet.

4. The image forming device as claimed in claim 1, further comprising:

a conveyance unit that conveys the recording sheet superposed with the gloss application sheet at least nearby the separation unit, wherein the conveyance unit is a conveyance belt, and conveys the gloss application sheet by adhering the gloss application sheet by an adhering effect of airflow, and in a direction of enlarging the space between the recording sheet and the gloss application sheet before the separation unit.

* * * * *